US007352329B2

(12) United States Patent
Chung et al.

(10) Patent No.: US 7,352,329 B2
(45) Date of Patent: Apr. 1, 2008

(54) MULTI-BAND ANTENNA WITH BROADBAND FUNCTION

(75) Inventors: Ming-Hsun Chung, Hsin-Tien (TW); Tsung-Wen Chiu, Hsin-Tien (TW); Ching-Feng Tseng, Hsin-Tien (TW); Yun-Fan Bai, Hsin-Tien (TW); An-Chia Chen, Hsin-Tien (TW); Fu-Ren Hsiao, Hsin-Tien (TW)

(73) Assignee: Advance Connectek, Inc., Hsin-Tien, Taipei Hsien (TW)

( * ) Notice: Subject to any disclaimer, the term of this patent is extended or adjusted under 35 U.S.C. 154(b) by 0 days.

(21) Appl. No.: 11/604,617

(22) Filed: Nov. 27, 2006

(65) Prior Publication Data

US 2007/0171130 A1 Jul. 26, 2007

(30) Foreign Application Priority Data

Jan. 20, 2006 (TW) ..... 95102140 A

(51) Int. Cl.
*H01Q 1/38* (2006.01)

(52) U.S. Cl. ..... 343/700 MS; 343/702

(58) Field of Classification Search ..... 343/700 MS, 343/702, 846, 848
See application file for complete search history.

(56) References Cited

U.S. PATENT DOCUMENTS

| | | | | |
|---|---|---|---|---|
| 6,774,850 | B2 * | 8/2004 | Chen | 343/700 MS |
| 6,836,252 | B2 * | 12/2004 | Tai et al. | 343/702 |
| 7,026,999 | B2 * | 4/2006 | Umehara et al. | 343/702 |
| 7,034,754 | B2 * | 4/2006 | Hung et al. | 343/700 MS |
| 7,061,437 | B2 * | 6/2006 | Lin et al. | 343/702 |
| 7,161,543 | B2 * | 1/2007 | Cheng et al. | 343/702 |
| 7,170,450 | B2 * | 1/2007 | Chang et al. | 343/700 MS |
| 2005/0128151 | A1 * | 6/2005 | Kwak et al. | 343/702 |
| 2006/0197705 | A1 * | 9/2006 | Chen et al. | 343/700 MS |
| 2007/0040750 | A1 * | 2/2007 | Tai et al. | 343/700 MS |
| 2007/0040754 | A1 * | 2/2007 | Liu et al. | 343/702 |
| 2007/0120753 | A1 * | 5/2007 | Hung et al. | 343/702 |
| 2007/0132646 | A1 * | 6/2007 | Hung et al. | 343/700 MS |
| 2007/0146216 | A1 * | 6/2007 | Wang et al. | 343/702 |
| 2007/0247372 | A1 * | 10/2007 | Huang | 343/700 MS |
| 2007/0257847 | A1 * | 11/2007 | Su et al. | 343/700 MS |

* cited by examiner

*Primary Examiner*—Tan Ho
(74) *Attorney, Agent, or Firm*—Jackson Walker, LLP

(57) ABSTRACT

A multi-band antenna with the broadband function is based upon a planar inverted-F antenna with two conductive arms and a ground. The two conductive arms extend from the ground near the two opposite ends of the ground. Two radiation plates of the two conductive arms extend toward each other. The multi-band antenna has a sufficient large band at high frequencies. Since the conductive arms are disposed close to the two ends of the ground, operations of bending the two conductive arms or soldering a feed wires are simpler and have a higher yield.

8 Claims, 3 Drawing Sheets

MULTI-BAND ANTENNA WITH BROADBAND FUNCTION

BACKGROUND OF THE INVENTION

1. Field of the Invention

The invention relates to a multi-band antenna with a broadband function and, in particular, to a multi-band antenna based upon a planar inverted-F antenna (PIFA) and having two conductive arms disposed at both ends of a ground, wherein the radiation plates of the conductive arms extend toward each other.

2. Description of Related Art

Personal mobile communications have great potential and business opportunities in the wireless communication industry. During their evolution, many systems adopting different techniques and channels have been developed. Therefore, they play important roles in different areas and markets. However, this phenomenon causes troubles and inconvenience for the system suppliers and consumers. One consequential point is that different systems, e.g., GSM900, DCS1800, and PCS1900, use different frequency bands.

For the convenience of users, manufacturers have spent a lot of manpower to develop multi-band mobile phones. Among all difficulties, the antenna is still the key factor in the wireless communications designs. It demands the following requirements.

1. Frequency and bandwidth.

2. Matches between the radiation field patterns and polarization of the antenna.

Compactness and light-weight are the trend in electronic product designs. The same also applies to mobile phones. This affects their antenna designs. The planar inverted-F antenna (PIFA) is thus widely used because its length can be reduced to ¼ wavelength (the length of a usual antenna is ½ wavelength). Therefore, it can greatly reduce the area occupied by the antenna in the electronics. Moreover, the PIFA helps achieving the object of hiding the antenna. The PIFA operated in a single frequency can be found in U.S. Pat. No. 5,764,190. Later on, for the PIFA to be operated in multiple frequencies, radiation metal plates are also formed with L-shaped or U-shaped holes.

Another antenna that achieves multi-band operations is shown in FIG. 1. The antenna includes a first radiating part A, a second radiating part B and a ground C. Both the first radiating part A and the second radiating part B extend from the opposite sides of the ground C. The first radiating part A includes a first conductive plate A1 parallel to the ground C and a first connecting part A2 that is connected between the first conductive plate A1 and the ground C. The radiating part B includes a second conductive plate B1 parallel to the ground C and a second connecting part B2 that is connected between the second conductive plate B1 and the ground C. The first conductive plate A1 and the second conductive plate B1 extend respectively from the first connecting part A2 and the second connecting part B2 toward the same direction.

Although the above-mentioned antenna can be operated in multiple frequency bands, it has the following disadvantages. The first connecting part A2 and the second connecting part B2 are too close to each other, and inconvenient for operations at high frequencies. Moreover, since the first conductive plate A1 and the second conductive plate B1 extend respectively from the first connecting part A2 and the second connecting part B2 toward the same direction, bending the first radiating part A and the second radiating part B is difficult when fabricating the antenna. It is also difficult to connect a feed wire to the first conductive plate A1 by soldering.

The invention thus proposes a design that can greatly enlarge the high frequency band for multi-band operations and simplify the antenna manufacturing as well.

SUMMARY OF THE INVENTION

An objective of the invention is to provide a multi-band antenna with the broadband function so that the multi-band antenna has a sufficiently large bandwidth at high frequencies.

Another objective is to provide a multi-band antenna with the broadband function so that the processes of bending two conductive arms and soldering a feed wire become simpler, promoting the product yield.

The invention utilizes the following technical features to achieve the above-mentioned objectives. The disclosed multi-band antenna is based upon a PIFA and includes a first conductive arm, a second conductive arm, a ground, and a feed wire. The ground has a first end, a second end, and two elongated sides connecting the first end and the second end. Each of the first conductive arm and the second conductive arm further comprises a radiating plate and a connecting plate. The connecting plate of the first conductive arm is connected to the ground near the first end. The connecting plate of the second conductive plate is connected to ground of the second end. Each of the radiating plates of the first and second conductive arms extends toward each other. In various embodiments of the invention, the radiating plates of the first and second conductive arms can be perpendicular or parallel to each other. However, their axes are parallel to the ground. The feed wire has a positive signal wire and a negative signal wire. The positive signal wire is electrically connected to the radiating plate of the first conductive arm. The negative signal wire is electrically connected to the ground.

Using the low fundamental frequency produced by the paths of the first and second conductive arms and the high fundamental frequency produced by the path of the first conductive arm, as well as properly determining a connection point where the positive signal wire of the feed wire connects to the radiating plate of the first conductive arm, the antenna has a good match or satisfactory bandwidths.

Besides, the connecting plate of the first conductive arm is connected to the ground near the first end, and the connecting plate of the second conductive arm is connected to the ground near the second end. The two connecting arms are thus farther from each other. Therefore, it is easier to perform the operations of bending the conductive arms and soldering the feed wire.

DETAILED DESCRIPTION OF THE PREFERRED EMBODIMENT

Figure 1:
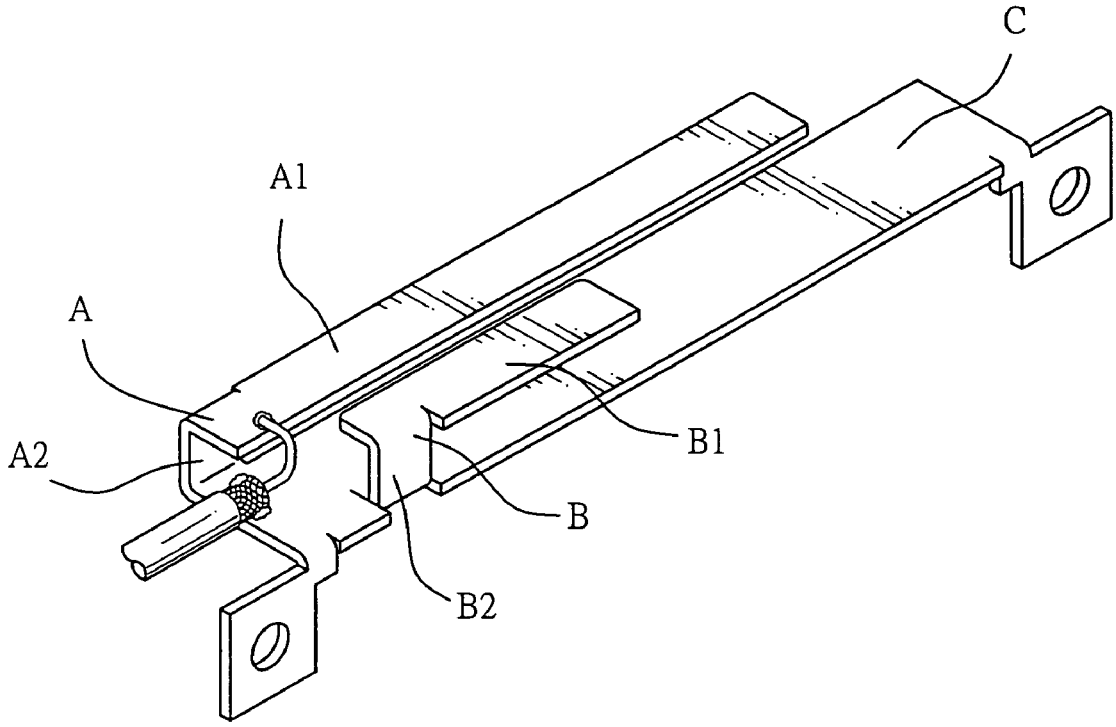
FIG. 1 PRIOR ART
FIG. 1 is a perspective view showing a conventional multi-band antenna.
Figure 2:
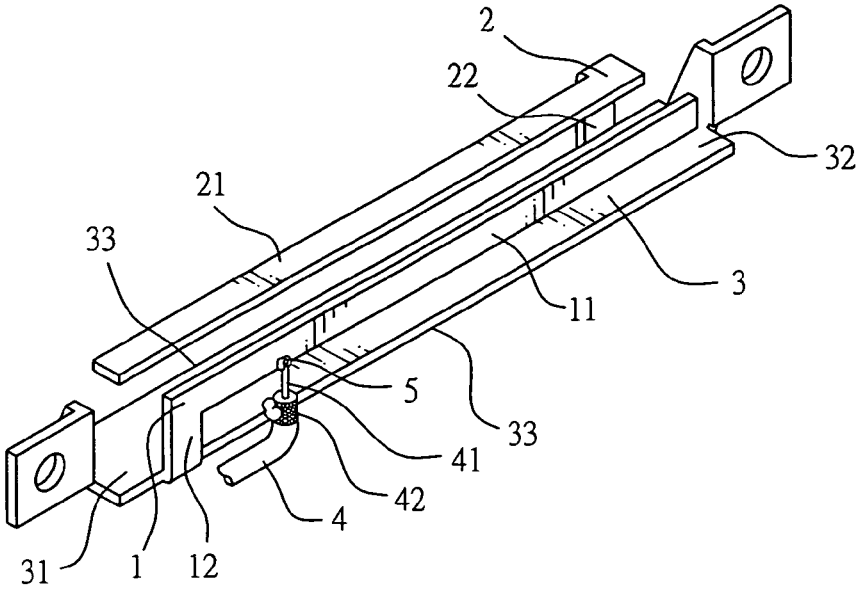
FIG. 2 is a perspective view showing an antenna according to a first embodiment of the invention.

A first embodiment of the invention is illustrated in FIG. 2. The multi-band antenna comprises a first conductive arm 1, a second conductive arm 2, a ground 3, and a feed wire 4. The ground 3 has a first end 31, a second end 32, and two elongated sides 33 connected with the first end 31 and the second end 32. Each of the first conductive arm 1 and the second conductive arm 2 further comprises a radiating plate 11, 21 and a connecting plate 12, 22. The connecting plate 12 of the first conductive arm 1 is connected to one of the elongated sides 33 of the ground 3 and is adjacent to the first end 31. The connecting plate 22 of the second conductive arm 2 is connected to the other elongated side 33 of the ground 3 and is adjacent to the second end 32. The radiating plate 11 of the first conductive arm 1 extends from the connecting plate 12 toward the second end 32. The radiating plate 21 of the second conductive arm 2 extends from the connecting plate 22 toward the first end 31. The radiating plate 11 of the first conductive arm 1 and the radiating plate 21 of the second conductive arm 2 are perpendicular to each other. That is, one of the radiating plates is parallel to the ground 3, and the other is perpendicular to the ground 3. A coaxial cable 4 further comprising a central wire 41 and an outer wire 42 is used as the signal feed wire. The central wire 41 of the coaxial cable 4 is a positive signal wire. The outer wire 42 of the coaxial cable 4 is a negative signal wire, i.e., ground. The central wire 41 is electrically connected to the radiating plate 11 of the first conductive arm 1 at a connection point 5. The outer wire 42 is electrically connected to the ground 3.

The connection point 5 between the central wire 41 and the first conductive arm 1 divides the radiating plate 11 into two segments. The ratio between the lengths of the two segments is about 1:4. The radiating plate 11 of the first conductive arm 1 is a rectangular stripe in the vertical direction. The radiating plate 21 of the second conductive arm 2 is a rectangular stripe in the horizontal direction.

Figure 3:
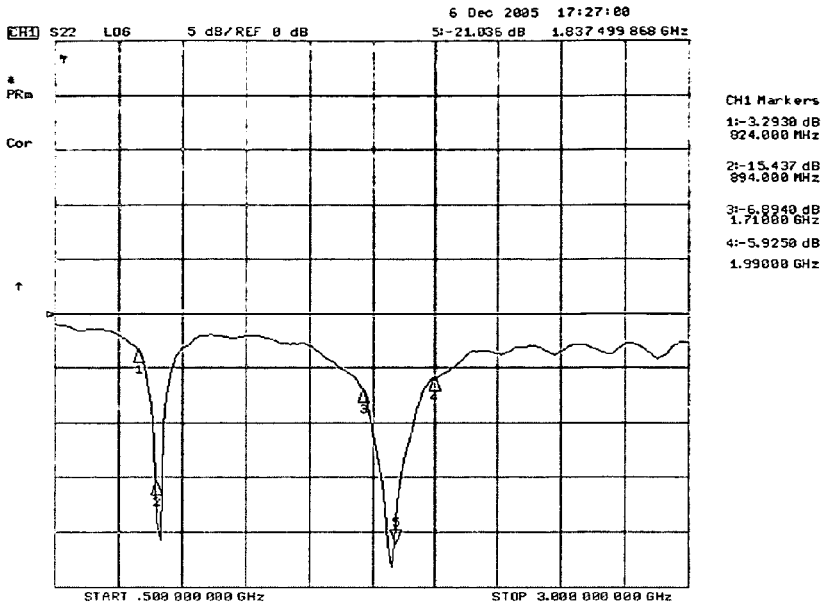
FIG. 3 shows return loss of the antenna shown in FIG. 2.

FIG. 3 shows the return loss of the multi-band antenna of the first embodiment. It is clear that the disclosed antenna has two operation bands. The operation bandwidths at both the low and high frequencies can satisfy the practical needs.

Figure 4:
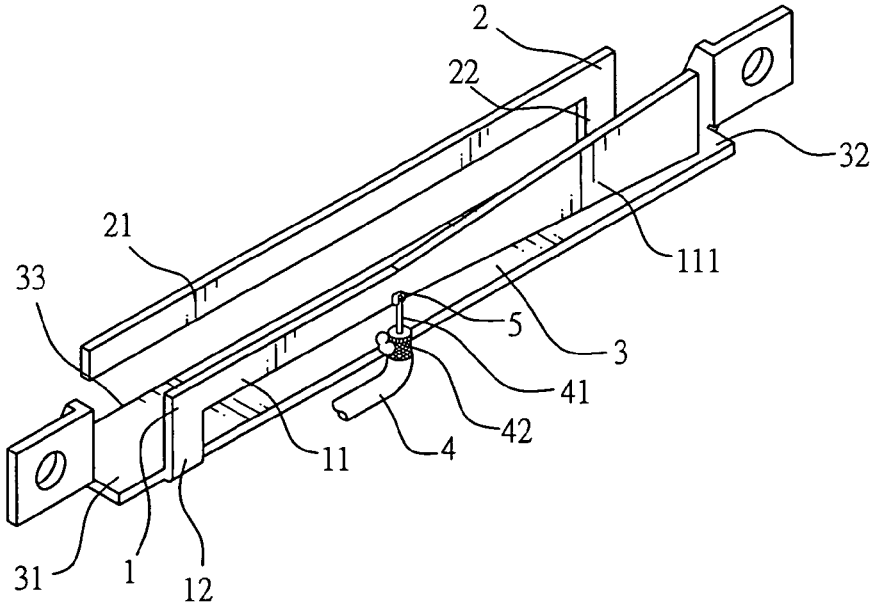
FIG. 4 is a perspective view showing an antenna according to a second embodiment of the invention.

With reference to FIG. 4, a second embodiment of the multi-band antenna comprises a first conductive arm 1, a second conductive arm 2, a ground 3, and a feed wire 4. The ground 3 has a first end 31, a second end 32, and two elongated sides 33 connected with the first end 31 and the second end 32. Each of the first conductive arm 1 and the second conductive arm 2 further comprises a radiating plate 11, 21 and a connecting plate 12, 22. The connecting plate 12 of the first conductive arm 1 is connected to one of the elongated sides 33 of the ground 3 near the first end 31. The connecting plate 22 of the second conductive arm 2 is connected to the other elongated side 33 of the ground 3 near the second end 32. The radiating plate 11 of the first conductive arm 1 extends from the connecting plate 12 toward the second end 32. The radiating plate 21 of the second conductive arm 2 extends from the connecting plate 22 toward the first end 31. In this embodiment, a coaxial cable 4 comprising a central wire 41 and an outer wire 42 is used as the signal feed wire. The central wire 41 of the coaxial cable 4 is a positive signal wire. The outer wire 42 of the coaxial cable is a negative signal wire i.e., ground. The central wire 41 is electrically connected to the radiating plate 11 of the first conductive arm 1 at the connection point 5. The outer wire 42 is electrically connected to the ground 3.

The connection point 5 between the central wire 41 and the radiating plate 11 of the first conducive arm 1 divides the radiating plate into two segments. The ratio between the two segments is between 1:1 and 1:1.5. The radiating plate 11 of the first conductive arm 1, i.e. the first segment, is a elongated thin vertical plate in the vertical direction. A widening protruding plate 111, i.e. the second segment, extends from the end opposite to the connecting plate 12 of the radiating plate 11. The radiating plate 21 of the second conductive arm 2 is an elongated rectangular plate in the vertical direction.

Figure 5:
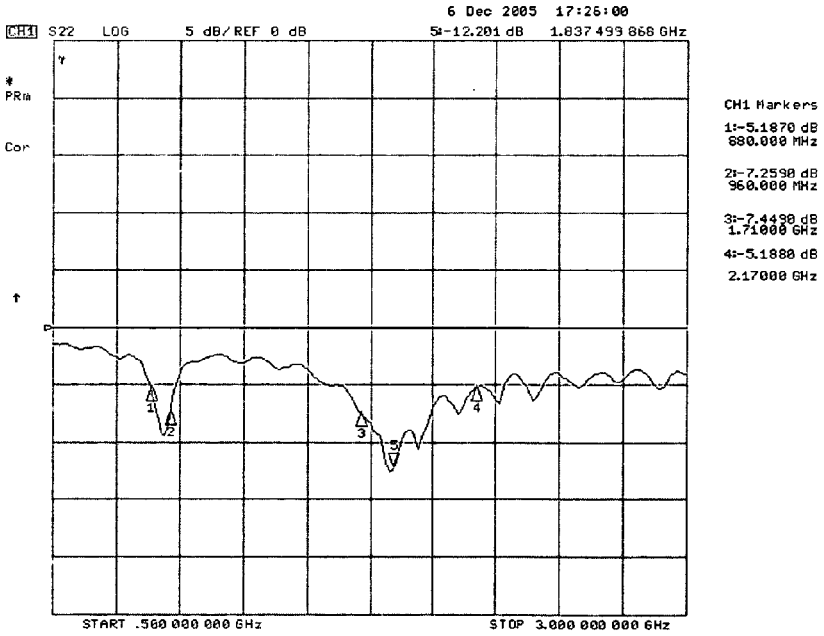
FIG. 5 shows return loss of the antenna shown in FIG. 4.

The return loss of the multi-band antenna of the second embodiment is shown in FIG. 5. As shown in the drawing, the disclosed antenna has two operation bands. The bandwidths in both of the operation bands can satisfy the requirements, particularly the bandwidth at the high-frequency band. It satisfies the requirements in the 800/900/1800/1900/2000 bands of GSM900, GSM850, DCS1800, PCS1900, and CDMA-2000.

What is claimed is:

1. A multi-band antenna comprising:

a ground having a first end, a second end, a first elongated side and a second elongated side;

a first conductive arm having a radiating plate and a connecting plate, the connecting plate of the first conductive arm connected to the first elongated side of the ground near the first end and extending toward the second end;

a second conductive arm having a radiating plate and a connecting plate, the connecting plate of the second conductive arm connected to the second elongated side of the ground near the second end and extending toward the first end; and a coaxial feed wire having a central wire and an outer wire, the central wire electrically connected to the radiating plate of the first conductive arm, and the outer wire electrically connected to the ground;

wherein the radiating plates of the first conductive arm and the second conductive arm are parallel to the ground.

2. The multi-band antenna as claimed in claim 1, wherein the positive signal wire of the feed wire is connected to the radiating plate of the first conductive arm at a connection point that divides the radiating plate into two segments with a length ratio of 1:4.

3. The multi-band antenna as claimed in claim 1, wherein the central wire of the feed wire is connected to the radiating plate of the first conductive arm at a connection point that divides the radiating plate into two segments with a length ratio between 1:1 and 1:1.5.

4. The multi-band antenna as claimed in claim 1, wherein the radiating plate of the first conductive arm is formed with a widening protruding plate extending toward a direction opposite to the connecting plate of the first conductive arm.

5. The multi-band antenna as claimed in claim 1, wherein the radiating plate of the second conductive arm is formed with a widening protruding plate extending toward a direction opposite to the connecting plate of the second conductive arm.

6. The multi-band antenna as claimed in claim 1, wherein the radiating plate of the first conductive arm is an elongated rectangular plate in the horizontal direction and the radiating plate of the second conductive arm is an elongated rectangular plate in the vertical direction.

7. The multi-band antenna as claimed in claim 1, wherein the radiating plate of the second conductive arm is an elongated rectangular plate in the horizontal direction and the radiating plate of the first conductive arm is an elongated rectangular plate in the vertical direction.

8. The multi-band antenna as claimed in claim 1, wherein the central wire is a positive signal wire and the outer wire is a negative signal wire.

* * * * *

UNITED STATES PATENT AND TRADEMARK OFFICE

CERTIFICATE OF CORRECTION

PATENT NO. : 7,352,329 B2
APPLICATION NO. : 11/604617
DATED : April 1, 2008
INVENTOR(S) : Ming-Hsun Chung et al.

It is certified that error appears in the above-identified patent and that said Letters Patent is hereby corrected as shown below:

On the title page item (73), should read: Assignee: ADVANCED CONNECTEK, INC.

Signed and Sealed this

Eighth Day of July, 2008

JON W. DUDAS
*Director of the United States Patent and Trademark Office*